US010577168B1

(12) United States Patent
Zimmerman

(10) Patent No.: US 10,577,168 B1
(45) Date of Patent: Mar. 3, 2020

(54) SELF-SEALING DISPENSER FOR SQUEEZABLE CONTAINER

(71) Applicant: Israel Harry Zimmerman, Los Angeles, CA (US)

(72) Inventor: Israel Harry Zimmerman, Los Angeles, CA (US)

( * ) Notice: Subject to any disclaimer, the term of this patent is extended or adjusted under 35 U.S.C. 154(b) by 0 days.

(21) Appl. No.: 16/206,815

(22) Filed: Nov. 30, 2018

(51) Int. Cl.
*B65D 83/00* (2006.01)

(52) U.S. Cl.
CPC ..... *B65D 83/0094* (2013.01)

(58) Field of Classification Search
CPC ..... B65D 83/0094
USPC ..... 222/213, 92, 95, 96
See application file for complete search history.

(56) References Cited

U.S. PATENT DOCUMENTS 1,770,630 A * 7/1930 Smith ..... B65D 47/2031 222/490
2,670,884 A 5/1951 Swartz
2,792,149 A 5/1957 Lutz
3,257,046 A 6/1966 Kasson
3,693,843 A 9/1972 Perry et al.
5,398,853 A 3/1995 Latham
6,726,063 B2 4/2004 Stull et al.
6,892,906 B2 * 5/2005 Py ..... A45D 40/26 222/494
7,845,517 B2 * 12/2010 Py ..... B65D 51/226 222/1
7,886,941 B2 2/2011 Pietrowski et al.
8,016,507 B2 * 9/2011 Wright ..... A45D 34/00 401/266
2007/0114250 A1 5/2007 Langseder et al.
2007/0295764 A1 * 12/2007 Socier ..... B65D 47/2031 222/494
2017/0158381 A1 6/2017 Holland et al.

FOREIGN PATENT DOCUMENTS

KR 20010001117 1/2001
KR 20120114130 10/2012

* cited by examiner

*Primary Examiner* — Jeremy Carroll
(74) *Attorney, Agent, or Firm* — Walter W. Duft

(57) ABSTRACT

A self-sealing dispenser for a squeezable container may include a flexible resilient member having an open base end, a substantially closed dispensing end formed with a self-opening and self-closing dispensing orifice, and an interior flow pathway that extends from the base end to the dispensing orifice. The flexible resilient member is mounted on a base member that is less flexible than the flexible resilient member. The base member has an exterior surface and an interior flow pathway in fluid communication with the resilient member interior flow pathway. The flexible resilient member may be attached to a nozzle portion of the base member exterior surface that extends into the resilient member interior flow pathway. The flexible resilient member may also be attached to a secondary attachment surface of the base member that does not form any part of the exterior surface of the base member.

21 Claims, 3 Drawing Sheets

SELF-SEALING DISPENSER FOR SQUEEZABLE CONTAINER

BACKGROUND

1. Field

The present disclosure relates to dispensers for squeezable containers. More particularly, the disclosure is directed to squeezable container dispensers that are self-sealing.

2. Description of the Prior Art

By way of background, squeezable containers are commonly used to hold flowable materials such as viscous fluids, pastes and the like (e.g., toothpaste). Squeezing such a container controllably expels the container contents through a dispenser situated at a dispensing end of the container.

In some instances, the dispenser may have a permanently-open orifice, such as a tubular nozzle, formed by a rigid material, such as plastic. Such dispensers are not self-sealing, and a manually-operable cap or valve is required in order to close the orifice when the container is not in use.

In other instances, the dispenser may have self-sealing orifice, such as a slit, formed by a flexible resilient material, such as rubber. Such dispensers are self-sealing. The orifice self-opens to expel the container contents in response to squeezing pressure applied to the container, then self-closes when the squeezing pressure is discontinued.

It is to improvements in the self-sealing variety of dispensers that the present disclosure is directed. In particular, a self-sealing dispenser for squeezable containers is provided that is simple in design, effective in use, and easy to manufacture.

SUMMARY

A self-sealing dispenser for a squeezable container may include a flexible resilient member having an open base end, a substantially closed dispensing end formed with a self-opening and self-closing dispensing orifice, and an interior flow pathway that extends from the base end to the dispensing orifice. The flexible resilient member is mounted on a base member that is less flexible than the flexible resilient member. The base member has an exterior surface and an interior flow pathway in fluid communication with the resilient member interior flow pathway. The flexible resilient member may be attached to a nozzle portion of the base member exterior surface that extends into the resilient member interior flow pathway. The flexible resilient member may also be attached to a secondary attachment surface of the base member that does not form any part of the exterior surface of the base member.

BRIEF DESCRIPTION OF THE DRAWINGS

The foregoing and other features and advantages will be apparent from the following more particular description of example embodiments, as illustrated in the accompanying Drawings, in which.

DETAILED DESCRIPTION OF EXAMPLE EMBODIMENTS

Figure 1:
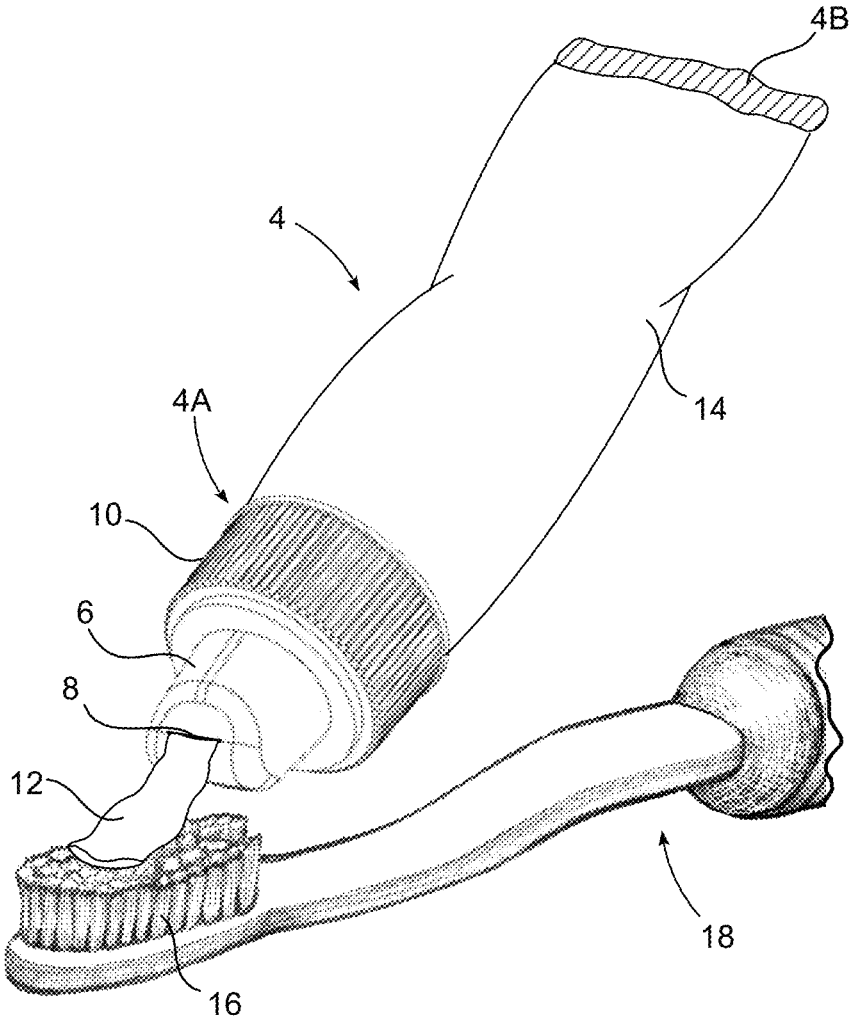
FIG. 1 is a diagrammatic perspective view showing a self-sealing dispenser mounted on a squeezable container according to one possible embodiment.

Turning now to the drawing figures, wherein like reference numbers illustrate like structure in all of the several views, FIG. 1 illustrates an example embodiment of a self-sealing dispenser 2 in combination with a squeezable container 4 containing a flowable material. The self-sealing dispenser 2 includes a flexible resilient member 6 having a self-opening/self-closing dispensing orifice 8 from which the flowable material is dispensed, and a base member 10 that mounts to a dispensing end of the squeezable container 4. FIG. 1 depicts the self-sealing dispenser 2 in an active state of dispensing a ribbon 12 of the squeezable container's flowable material in response to a squeezing force applied to the container's flexible sidewall 14.

The flexible resilient member 4 may be formed from any suitably flexible and resilient elastomeric material that will allow the dispensing orifice 6 to self-open in response to internal pressure exerted by the flowable material as the squeezable container 4 is squeezed to expel the material, and will thereafter allow the dispensing orifice to self-close when squeezing is discontinued and the internal pressure is removed. Thermoplastic elastomers (TPE), also known as thermoplastic rubbers, represent example materials that may be used for the flexible resilient member 4. Other suitable materials that may be used include silicone, natural rubber, and synthetic rubber (such as isoprene). It will be appreciated that the choice of materials may depend on the nature of the flowable material for which the self-sealing dispenser 2 is used.

The base member 6 will generally be less flexible (i.e., more rigid) than the flexible resilient member 4. By way of example, the base member 6 may be formed from thermoplastic materials, such as polypropylene (PP), high density polyethylene (HDPE), polyethylene terephthalate (PET), nylon, as well as thermoset materials.

The squeezable container 4 may be embodied as any type of squeezable tube, bottle, bag, or the like that is suitable for packaging and dispensing flowable materials. The squeezable container 4 may be formed from any suitable flexible material. In most cases (but not necessarily all) the selected flexible material will be one that allows the container to be deformed by hand pressure alone. Examples include thermoplastic materials such as low density polyethylene (LDPE), thermoelastic materials such as thermoplastic elastomers (TPE), flexible laminate materials such as ethylene vinyl alcohol resin, or various combinations thereof. Flexible metal containers made of thin-walled aluminum or the like may also be used.

Typically, the squeezable container 4 will have a closed end and an open end to which the self-sealing dispenser 2 is mounted. Details regarding alternative ways that the self-sealing dispenser can be mounted to the squeezable container 4 are discussed below.

In the illustrated embodiment of FIG. 1, the squeezable container 4 is a flexible toothpaste tube containing toothpaste. The tube has an open first end 4A to which the self-sealing dispenser 2 is mounted, and a flattened, closed second end 4B. In FIG. 1, the flexible sidewall 14 of the squeezable container 4 has been squeezed to increase the internal pressure within the container, and thereby expel the toothpaste (as ribbon 12) onto the bristles 16 of a toothbrush 18. Alternatively, the internal pressure could be raised by rolling up the closed base end 4B of the squeezable container 4, either by hand or by using a tube key.

Other flowable materials that could be contained within the squeezable container 4 include various types of viscous fluids, pastes, gels, powders, and the like. Such materials could include foodstuffs (such as condiments), personal care products such as (such as soaps, shampoos, lotions, creams, ointments, etc.), cleaning products (such as polishes, waxes, cleaning pastes, etc.) industrial products (such as lubricants, caulks, sealers, fillers, etc.), arts and crafts products (such as paints, pastes, glues, etc.), to name but a few.

Figure 2:
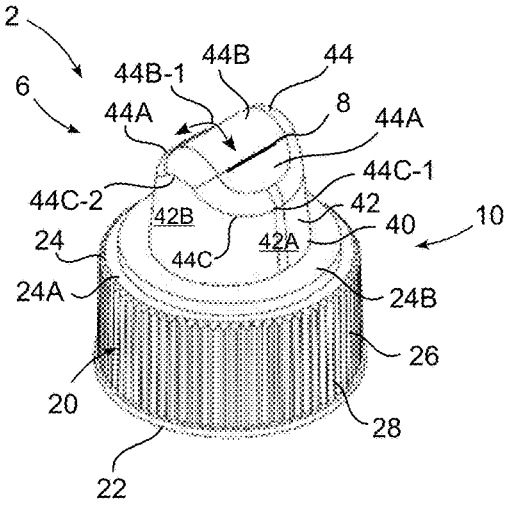
FIG. 2 is perspective view showing the dispensing end of the self-sealing dispenser of FIG. 1.
Figure 3:
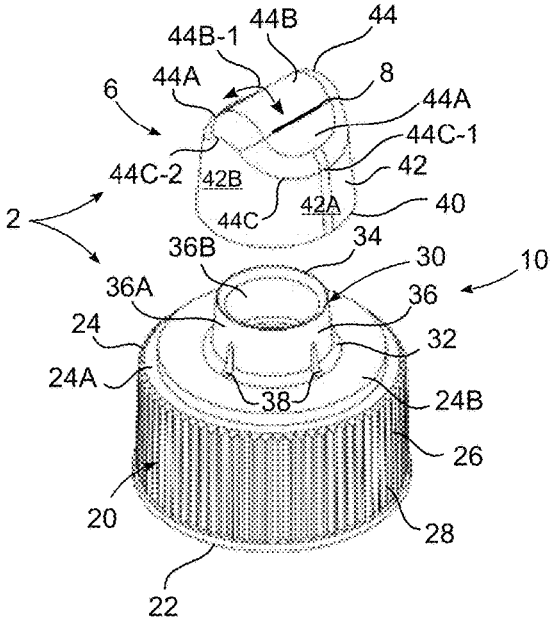
FIG. 3 is an exploded perspective view of the self-sealing dispenser of claim 1 showing an example flexible resilient member and an example base member thereof.
Figure 4:
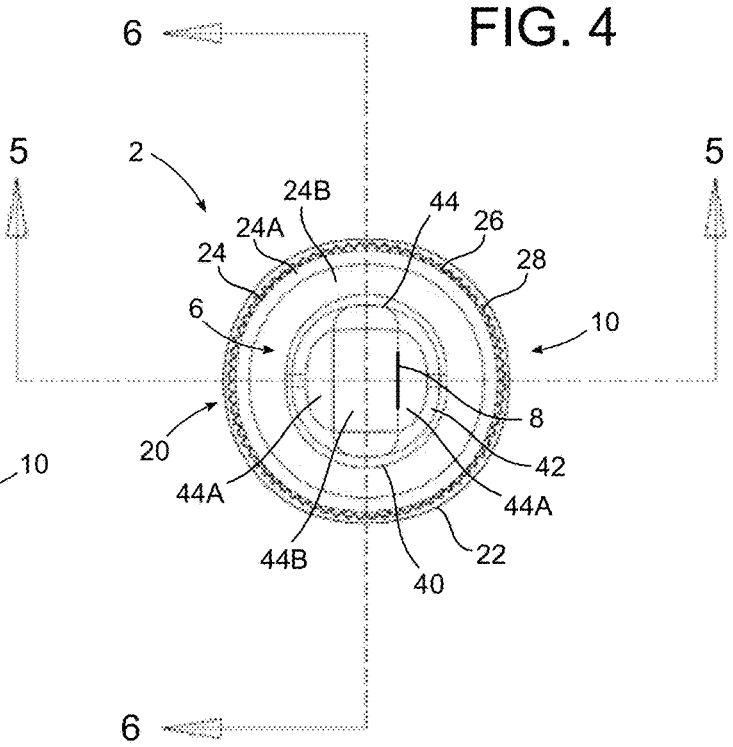
FIG. 4 is a top plan view of the self-sealing dispenser of FIG. 1.

FIGS. 2-4 depict the exterior of the base member 10 and the flexible resilient member 6 of the self-sealing dispenser 2 according to an example embodiment. FIGS. 2 and 4 respective perspective and top plan views of the self-sealing dispenser 2 in its assembled stated, i.e., with the flexible resilient member 6 mounted on the base member 10. FIG. 2 is an exploded perspective view of the self-sealing dispenser 2 showing the flexible resilient member 6 removed from the base member 10.

In an embodiment, the base member 10 may be formed as a unitary (single-piece) structure, although non-unitary (multi-piece) structures could also be used. In an embodiment, the base member includes a lower exterior cap structure 20 having a substantially circular exterior bottom rim 22, a generally disk-shaped upper exterior shoulder 24, and a substantially cylindrical exterior sidewall 26 extending between the bottom exterior rim and the upper exterior shoulder. The exterior sidewall 26 may be textured for gripping, for example with a plurality of vertical gripping ribs 28. The upper exterior shoulder 24 may include an outer annular shoulder portion 24A extending radially inwardly from the exterior sidewall 26 and located at a first distance from the bottom exterior rim 22. The upper exterior shoulder 24 may further include a raised inner annular shoulder portion 24B that is concentric with the outer annular portion 24A and located at a second distance from the bottom exterior rim 22, the second distance being larger than the first distance.

As can be seen in FIG. 3, an upper nozzle 30 of the base member 10 extends upwardly from the inner annular shoulder 24B. The nozzle 30 acts as a rigid main support for the flexible resilient member 6. The nozzle 30 also serves as a rigid flow regulator for the flowable material. The flow regulating functions of the nozzle 30 include directing flowable material from the squeezable container 4 and to the dispensing orifice 8 when a squeezing force is applied to the container. The nozzle 30 also facilitates withdrawing the flowable material back from the dispensing orifice 8 and returning it to the squeezable container 4 when the squeezing force is removed. This helps prevent clogging of the dispensing orifice 8.

In an embodiment, the nozzle 30 may have a generally circular lower base 32 where it meets the inner annular shoulder portion 24B of the cap structure's upper exterior shoulder 24, and a generally circular upper terminal rim 34. Extending between the lower base 32 and the upper rim 34 of the nozzle 30 is a generally tubular sidewall 36. In an embodiment, the nozzle sidewall 36 includes an exterior nozzle sidewall surface 36A and an interior nozzle sidewall surface 36B, both of which are generally cylindrical in shape but may taper slightly inwardly toward the nozzle rim 34 if desired. Non-tubular nozzle configurations may also be used, including configurations having elongated (e.g., oval) cross-sections, polygonal cross-sections, irregular cross-sections, etc.

In an embodiment, the base member 10 may include a set of anchoring ports 38 that can be used to provide robust attachment of the resilient member 6 to the base member (as described in more detail below). Robust attachment of the resilient member 6 is advantageous because the resilient member needs to remain in place despite being repeatedly acted upon by pressure forces exerted by the flowable material as the squeezable container 4 is squeezed. FIG. 3 shows two anchoring ports 38 located at the base 32 of the nozzle 30, it being understood that two additional anchoring ports may be provided on the non-visible side of the nozzle, for a total of four anchoring ports located approximately 90 degrees from each other around the circumference of the nozzle 30. The anchoring ports 38 may be formed as through-bores that extend completely through the base member 10, or they may be formed as blind bores that extend only partially through the base member 10.

With continuing reference to FIGS. 2-4, the resilient member 6 may be formed as a an upright structure having a substantially circular exterior bottom rim 40 located at the inner annular shoulder portion 24B of the cap structure's upper exterior shoulder 24. The bottom rim 40 defines an open base end of the resilient member 6. In an embodiment, a generally tubular sidewall 42 of the resilient member 6 extends upwardly from the bottom rim 40 to an upper dispensing end 44 that is substantially closed except for the dispensing orifice 8.

Figure 5:
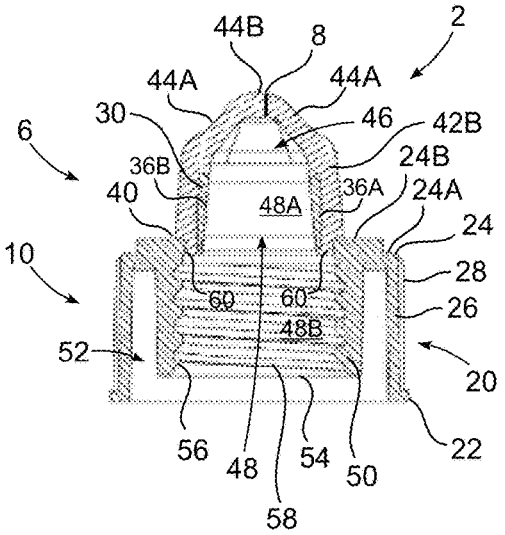
FIG. 5 is a cross-sectional view taken along line 5-5 in FIG. 4.

In an embodiment, the dispensing end 44 of the resilient member 6 is an includes a pair of angled sides 44A that are downwardly-extending and outwardly-angled from an elongated apex 44B. In an embodiment, the general shape of the dispensing end 44 may be that of an inverted partially-folded circle (i.e., a taco-shell shape) having a curved lower edge 44C of varying height. However, unlike a taco shell, the sides 44A of the dispensing end 44 may be concave rather than linear (e.g., as shown in FIG. 5). In the illustrated embodiment, the dispensing end 44 of the resilient member 6 has a generally pointed shape when viewed in the lengthwise direction of the elongated apex 44B, but has a generally trapezoidal shaped when viewed orthogonally to the lengthwise direction. In other embodiments (not shown), the dispensing end 44 of the resilient member 6 could have other shapes that are not elongated, such as conical-shapes, dome-shapes, etc.

Although the sidewall 42 of the resilient member 6 is generally tubular, it may have a slight inward taper from the bottom rim 40 to the upper dispensing end 44 that conforms to a corresponding taper of the base member nozzle 30. The height of sidewall 42 varies around its circumference according to where it meets the curved lower edge 44C of the dispensing end 44. The sidewall 42 is at its shortest height at circumferential locations 42A where it meets the lowermost portion 44C-1 of the dispensing end's curved lower edge 44C. In an embodiment, this sidewall height may correspond to the height of the base member nozzle 30 at its upper rim 34. The sidewall 42 has its tallest height at locations 42B where it meets the uppermost portion 44C-2 of the dispensing end's curved lower edge 44C.

In an embodiment, the elongated apex 44B of the dispensing end 44 may be formed as an linear ridge that is substantially straight for a majority of its length, and which has a convexly rounded surface 44B-1 extending in a transverse direction that is orthogonal to the lengthwise direction. As previously noted, the dispensing end 44 of the resilient member 6 may have two angled sides 44A that may be concave. As also previously noted, the angled sides 44A of the dispensing end 44 angle downwardly and outwardly from the elongated apex 44B to the sidewall portion 42 of the resilient member 6. By increasing the concavity of the angled sides 44A, the elongated apex 44B becomes more upwardly protruding and pointed in appearance.

In an embodiment, the dispensing orifice 8 may be formed as a linear slit that extends substantially parallel to the elongation direction of the resilient member's elongated apex 44B. In an embodiment (not shown), the dispensing orifice 8 may be directly aligned with the central peak of the linear ridge that defines the elongated apex 44B. In another embodiment, shown in FIGS. 2-3, the dispensing orifice 8 may be offset from the central peak of the linear ridge that defines the elongated apex 44B. In particular, the dispensing orifice 8 may lie in an area that extends transversely from the central peak of the linear ridge, up to and including an inflection point where the convexly rounded transverse surface 44B-1 of the elongated apex 44B transitions into one of the concave angled sides 44A.

It has been found that this positioning of the dispensing orifice 8 assists in maintaining the orifice clean and free of flowable material following use of the self-sealing dispenser 2, particularly when the flowable material is applied with the dispenser oriented in the manner shown in FIG. 1. In this orientation, the elongated apex 44B is below the dispensing orifice 8, and its elongation direction is transverse to the direction of movement of the dispensing end 44 as the flowable material is expelled therefrom. The above-mentioned self-cleaning property of the dispensing end 44 may be due at least in part to the rounded transverse surface 44C of the central linear apex 44B helping to pull away flowable material from the dispensing orifice 8 after it closes. Experiments have shown that this self-cleaning effect is not as reliable when the dispensing orifice is placed on the central ridge peak of the elongated apex 44B. In this orientation, the dispensing orifice will oriented in the direction of movement of the dispensing end 44 as the flowable material is expelled therefrom.

Figure 2A:
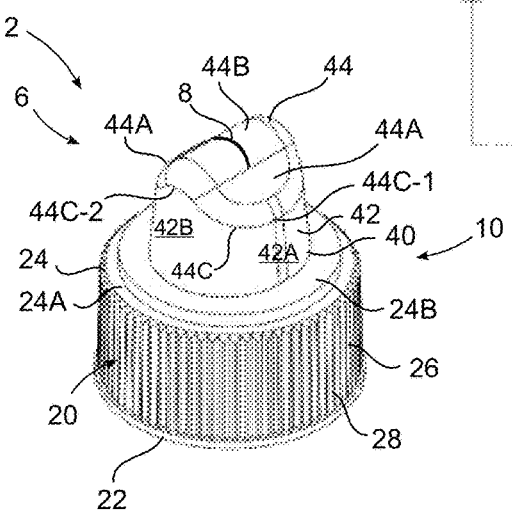
FIG. 2A is perspective view showing an alternative dispensing end that may be provided on the self-sealing dispenser of claim 1.

FIG. 2A shows an alternative embodiment wherein the dispensing orifice 8 has been rotated 90 degree so that it is transverse to the elongation direction of the resilient member's elongated apex 44B. Experiments have shown that this positioning also assists in maintaining the orifice clean and free of flowable material following use of the self-sealing dispenser 2, particularly when the flowable material is applied with the dispenser oriented in the manner shown in FIG. 1.

As previously mentioned, the dispensing end 44 of the resilient member 6 does not have to be elongated, and could instead have any of various alternative shapes, such as a conical shape, a dome shape, a flat shape, etc. Moreover, instead of the dispensing orifice 8 being a linear slit, it could have various non-linear shapes, including a star shape, an x-shape, a y-shape, a z-shape, and many others.

Figure 6:
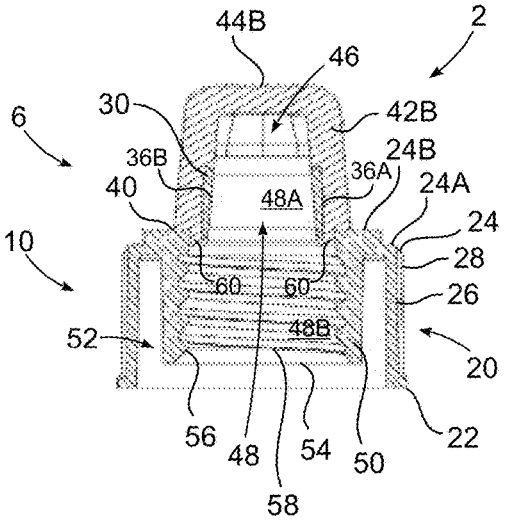
FIG. 6 is a cross-sectional view taken along line 6-6 in FIG. 4.

Turning now to FIGS. 5 and 6, the mutually-orthogonal cross-sections defined in FIG. 4 are illustrated. The flexible resilient member 6 is shown to include an interior flow pathway 46 extending from its open base end (inside the lower rim 40) to the dispensing orifice 8 formed in the otherwise substantially closed dispensing end 44. The flexible resilient member 44 is shown to be mounted on the outside of the nozzle 30 of the base member 10, with the nozzle extending into the flexible resilient member's interior flow pathway 46. As previously indicated, the base member 10 is less flexible than the flexible resilient member 6, so that the nozzle 30 provides interior support for the resilient member's sidewall 42. The nozzle 30 thereby acts to prevent deformations of the flexible member sidewall 42 that could otherwise result from fluctuations in internal pressure exerted by the flowable material in the squeezable container 4. As previously mentioned, this represents a flow regulating function whereby flowable material is delivered directly through the nozzle 30 to the dispensing end 44 of the resilient flexible member 6 during use. The nozzle 30 provides a reverse flow regulating function as squeezing pressure is removed by providing a pathway for flowable material to be pulled by negative pressure back into the squeezable container such that none remains in the flexible member's dispensing end 44.

Figure 7:
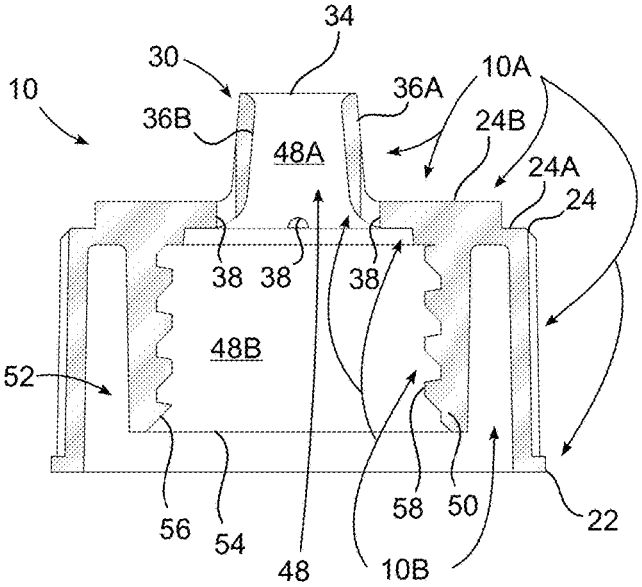
FIG. 7 is an enlarged cross-sectional centerline view of an example base member of the self-sealing dispenser of FIG. 1.

As shown in FIG. 7, the base member 10 has an overall exterior surface 10A defined by the combination of the exterior bottom rim 22, the upper exterior shoulder 24 and the exterior sidewall 26 of the exterior cap structure 20, and by the exterior sidewall surface 36A of the nozzle 30. In an embodiment, any area of the interior base member 10 that is not part of the base member exterior surface 10A may be thought of as an interior portion of the base member. Reference numeral 10B in FIG. 7 illustrates several representative interior portions of the base member 10. The base member 10 has an interior flow pathway 48 in fluid communication with the resilient member interior flow pathway 46. In an embodiment, the interior flow pathway 48 may be generally configured as a stepped cylindrical bore. In an embodiment, an upper smaller diameter portion 48A of the base member interior flow pathway 48 may be formed by the interior sidewall surface 36B of the base member nozzle 30. A lower larger diameter portion 48B of the base member interior flow pathway 48 may be formed by an interior cap structure 50 formed concentrically within the exterior cap structure 20 of the base member 6, and optionally offset therefrom by an annular space 52.

The interior cap structure 50 may extend downwardly from the upper annular shoulder 24 of the cap structure 20 to a lower interior cap rim 54. The interior cap structure 50 may be formed with an interior wall surface 56 that defines the lower portion 48B of base member interior flow pathway 48. In an embodiment, the interior wall surface 56 may be formed with threads 58 that allow the self-sealing dispenser 2 to be threadably mounted onto the squeezable container 4 in the event that the container is formed with a threaded nozzle (not shown), as is the case with many toothpaste tubes.

The flexible resilient member 6 may be attached to the exterior sidewall surface 36A of the base member nozzle 6, which as noted extends into the resilient member interior flow pathway 46. The flexible resilient member 6 may be secured in place using a suitable adhesion technique, such as heat-induced adhesion that may be implemented by injection-molding the flexible resilient member around the nozzle 6.

The flexible resilient member 6 may also be attached to a secondary attachment surface associated with the interior portion 10B of the base member 10 that does not form any part of the base member exterior surface 10A. In an embodiment, secondary attachment surfaces of the base member 10 may be formed by the previously-described base member anchoring ports 38. The anchoring ports 38 can extend inwardly from any portion of the exterior surface 10A of the base member 10. In an embodiment best illustrated by FIGS. 3 and 7, the anchoring ports 38 may be formed as through-bores that extend completely through the upper annular shoulder 24 of the base member cap structure 20, at the base of the nozzle 30, to reach the base member interior flow pathway 48.

As shown in FIGS. 5-6, the resilient member 6 may include one or more anchors 60 that extend into, and possibly through the anchoring ports 38. The resilient member anchors 60 may be introduced into the anchoring ports during formation of the resilient member 6 when it is in a heated flowable state. In that case, resilient member anchors 60 may not only extend through the anchoring ports 38, they may flow beyond the exit points of the anchoring ports onto surrounding surfaces within the interior flow pathway 48 of the base member 10. These surrounding surfaces represent further examples of secondary attachment surfaces for attaching the resilient member 6 to the base member 10. More generally, any interior surface that forms part of the base member interior airflow pathway 48, or which forms part of the annular space 52 in the embodiment of FIGS. 5-7, could be used as a secondary attachment surface.

As previously mentioned, the anchoring ports 38 could be formed alternatively as blind bores that extend only partially through the base member 10. In that case, the resilient member anchors 60 would not reach any other attachment surface within the base member interior portion 10B.

Although the anchoring ports 38 are shown to be oriented vertically in-line with the overall base member 10, the anchoring ports 38 could be formed at any other suitable angle, including as horizontal bores extending inwardly from the exterior sidewall 36A of the nozzle 30.

Other anchoring structures could likewise be used to provide secondary attachment surfaces in lieu of the anchoring ports 38. By way of example only, an annular anchoring channel could be formed around the circumference of the nozzle's exterior sidewall 36A, which may otherwise be smooth.

Figure 8:
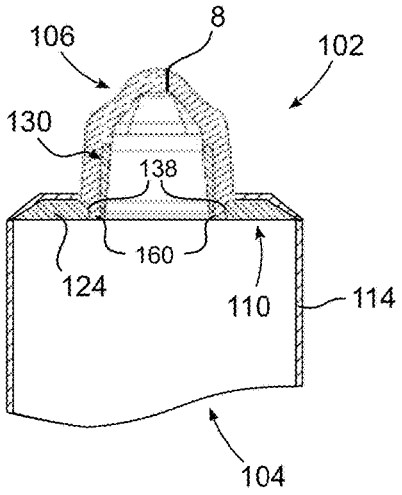
FIG. 8 is a cross-sectional centerline view showing a self-sealing dispenser mounted on a squeezable container according to another embodiment.

Turning now to FIG. 8, a modified self-sealing dispenser 102 representing an alternative embodiment is shown. The self-sealing dispenser 102 may be similar in most respects to the self-sealing dispenser 2 described above, as shown by the use of corresponding reference numbers incremented by 100. The principal difference between the self-sealing dispensers 2 and 102 and is that the latter is configured for permanent mounting to a squeezable container 104 having no existing nozzle. The dispenser 102 would thus typically be sold in combination with the squeezable container 104 as a self-contained product. To produce the self-sealing dispenser 102, the base member 110 thereof may be modified to include only a nozzle 130 (corresponding to the nozzle 30 of the base member 10) that extends from an annular flange 124 (corresponding to the annular shoulder 24 of the base member 10). The annular flange 124 may be mounted directly to the flexible sidewall 114 of the squeezable container 104, thereby providing a closure for the container. The resilient member 106 may be mounted on the base member 110 by attaching it to the nozzle 130 and to a suitable secondary attachment surface of the base member using any of the previously-described secondary attachment techniques. Thus, the resilient member 106 may have anchors 160 that extend through anchoring ports 138 formed in the base member 110. Another convenient secondary attachment method would be to form the resilient member 106 with an additional lower extension that can wrap around the outside of the annular flange 124 and engage a secondary attachment surface provided by the underside of the flange.

Although example embodiments of the disclosed subject matter have been shown and described, it should be apparent that many variations and alternative embodiments could be implemented in accordance with the present disclosure. It is understood, therefore, that the invention is not to be in any way limited except in accordance with the spirit of the appended claims and their equivalents.

What is claimed is:

1. A self-sealing dispenser for a squeezable container, comprising:

a flexible resilient member having an open base end, a substantially closed dispensing end formed with a self-opening and self-closing dispensing orifice, and an interior flow pathway that extends from the base end to the dispensing orifice;

a base member on which the flexible resilient member is mounted, the base member being less flexible than the flexible resilient member;

the base member having an exterior surface and an interior flow pathway in fluid communication with the resilient member interior flow pathway;

the flexible resilient member being attached to a nozzle portion of the base member exterior surface that extends into the resilient member interior flow pathway; and the flexible resilient member also being attached to a secondary attachment surface of the base member that does not form any part of the exterior surface of the base member.

2. The self-sealing dispenser of claim 1, wherein the secondary attachment surface of the base member is formed by one or more anchoring ports that extend inwardly from the exterior surface of the base member.

3. The self-sealing dispenser of claim 2, wherein the flexible resilient member comprises one or more anchors that extend into the one or more anchoring ports of the base member.

4. The self-sealing dispenser of claim 1, wherein the secondary attachment surface of the base member is formed by an attachment surface in an interior portion of the base member.

5. The self-sealing dispenser of claim 1, wherein the secondary attachment surface of the base member is formed by one or more anchoring ports that extend from the exterior surface of the base member to a further secondary attachment surface in an interior portion of the base member.

6. The self-sealing dispenser of claim 5, wherein the flexible member comprises one or more anchors that extend through the one or more through anchoring ports of the base member and engage the further secondary attachment surface in the interior portion of the base member.

7. The self-sealing dispenser of claim 1, wherein the flexible member is attached to the nozzle portion of the base member exterior surface by way of heat-induced adhesion.

8. The self-sealing dispenser of claim 1, wherein the substantially closed dispensing end of the flexible resilient member comprises an elongated central apex defined by a linear ridge and a pair of downwardly-extending, outwardly-angled sides, and wherein the dispensing orifice of the flexible resilient member comprises a linear slit that is offset from a central peak of the linear ridge that defines the elongated apex toward toward one of the angled sides, the slit being parallel to an elongation direction of the apex.

9. The self-sealing dispenser of claim 1, wherein the substantially closed dispensing end of the flexible resilient member comprises an elongated central apex defined by a linear ridge and a pair of downwardly-extending, outwardly-angled sides, and wherein the dispensing orifice of the flexible resilient member comprises a linear slit on a central peak of the linear ridge that defines the elongated apex, the slit being oriented transversely to an elongation direction of the apex.

10. The self-sealing dispenser of claim 1, wherein the base member is configured with either (1) inside threads for attaching the dispenser to a threaded nozzle on a squeezable container, or (2) a flange for permanent mounting to a squeezable container having no nozzle.

11. A combination, comprising:

a squeezable container, comprising:

a closed end;

an open end; and a flexible wall defining an interior chamber for holding flowable container contents;

a self-sealing dispenser, comprising:

a flexible resilient member having an open base end, a substantially closed dispensing end formed with a self-opening and self-closing dispensing orifice, and an interior flow pathway that extends from the base end to the dispensing orifice;

a base member on which the flexible resilient member is mounted, the base member being less flexible than the flexible resilient member;

the base member having an exterior surface and an interior flow pathway in fluid communication with the resilient member interior flow pathway;

the flexible resilient member being attached to a nozzle portion of the base member exterior surface that extends into the resilient member interior flow pathway; and the flexible resilient member also being attached to a secondary attachment surface of the base member that does not form any part of the exterior surface of the base member.

12. The combination of claim 11, wherein the flexible member is attached to the nozzle portion of the base member exterior surface by way of heat-induced adhesion.

13. The combination of claim 11, wherein the secondary attachment surface of the base member is formed by one or more anchoring ports that extend inwardly from the exterior surface of the base member.

14. The combination of claim 13, wherein the flexible resilient member comprises one or more anchors that extend into the one or more anchoring ports of the base member.

15. The combination of claim 11, wherein the secondary attachment surface of the base member is formed by an attachment surface in an interior portion of the base member.

16. The combination of claim 11, wherein the secondary attachment surface of the base member is formed by one or more anchoring ports that extend from the exterior surface of the base member to a further secondary attachment surface in an interior portion of the base member.

17. The combination of claim 16, wherein the flexible member comprises one or more anchors that extend through the one or more through anchoring ports of the base member and engage the further secondary attachment surface in the interior portion of the base member.

18. The combination of claim 11, wherein the substantially closed dispensing end of the flexible resilient member comprises an elongated central apex defined by a linear ridge and a pair of downwardly-extending outwardly-angled sides, and wherein the dispensing orifice of the flexible resilient member comprises a slit that is offset from a central peak of the linear ridge that defines the elongated apex toward toward one of the angled sides, the slit being oriented parallel to an elongation direction of the apex.

19. The combination of claim 11, wherein the substantially closed dispensing end of the flexible resilient member comprises an elongated central apex defined by a linear ridge and a pair of downwardly-extending, outwardly-angled sides, and wherein the dispensing orifice of the flexible resilient member comprises a linear slit on a central peak of the linear ridge that defines the elongated apex, the slit being oriented transversely to an elongation direction of the apex.

20. The combination of claim 11, wherein the base member is configured with either (1) inside threads for attaching the dispenser to a threaded nozzle on a squeezable container, or (2) a flange for permanent mounting to a squeezable container having no nozzle.

21. A self-sealing dispenser for a squeezable container, comprising:

a flexible resilient member having an open base end, a substantially closed dispensing end formed with a self-opening and self-closing dispensing orifice, and an interior flow pathway that extends from the base end to the dispensing orifice;

a base member on which the flexible resilient member is mounted, the base member being less flexible than the flexible resilient member;

the base member having an exterior surface and an interior flow pathway in fluid communication with the resilient member interior flow pathway;

the flexible resilient member being attached to a nozzle portion of the base member exterior surface that extends into the resilient member interior flow pathway;

the flexible resilient member also being attached to a secondary attachment surface of the base member that does not form any part of the exterior surface of the base member;

the secondary attachment surface of the base member being formed by one or more anchoring ports that extend from the exterior surface of the base member to a further secondary attachment surface in an interior portion of the base member;

the flexible member including one or more anchors that extend through the one or more through anchoring ports of the base member and engage the further secondary attachment surface in the interior portion of the base member;

the flexible member being attached to the nozzle portion of the base member exterior surface by way of heat-induced adhesion;

the substantially closed dispensing end of the flexible resilient member comprising an elongated central apex defined by a linear ridge and a pair of downwardly-extending outwardly-angled sides, and wherein the dispensing orifice of the flexible resilient member comprises a slit that is offset from a central peak of the linear ridge that defines the elongated apex toward toward one of the angled sides; and the base member being configured with either (1) inside threads for attaching the dispenser to a threaded nozzle on a squeezable container or (2) a flange for permanent mounting to a squeezable container having no nozzle.

* * * * *